US006732987B2

(12) United States Patent
Wooten et al.

(10) Patent No.: US 6,732,987 B2
(45) **Date of Patent: *May 11, 2004**

(54) ADJUSTABLE WEAPON AUXILIARY MOUNT

(75) Inventors: Donald W. Wooten, Dallas, TX (US); John W. Woodmansee, III, Plano, TX (US)

(73) Assignee: Tactical & Rescue Equipment L.L.C., Plano, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/407,619

(22) Filed: Apr. 4, 2003

(65) Prior Publication Data

US 2003/0189146 A1 Oct. 9, 2003

Related U.S. Application Data

(63) Continuation of application No. 10/122,273, filed on Apr. 12, 2002, now abandoned, which is a continuation-in-part of application No. 09/882,791, filed on Jun. 14, 2001, now Pat. No. 6,425,561, which is a continuation of application No. 09/434,214, filed on Nov. 4, 1999, now abandoned.

(60) Provisional application No. 60/107,766, filed on Nov. 9, 1998.

(51) Int. Cl.[7] ..... A47B 96/06

(52) U.S. Cl. ..... 248/229.1; 362/113

(58) Field of Search ..... 248/229.1, 229.12, 248/229.15, 230.3, 231.21, 316.4, 220.21, 70, 74.3, 74.4; 42/101, 103; 362/110, 113, 114; 33/245

(56) References Cited

U.S. PATENT DOCUMENTS

| | | | | | |
|---|---|---|---|---|---|
| 552,951 | A | * | 1/1896 | Bower | 269/76 |
| 2,876,027 | A | * | 3/1959 | Sulmonetti | 403/53 |
| 3,506,227 | A | * | 4/1970 | Jenkins | 248/59 |
| 3,750,318 | A | * | 8/1973 | Burris | 42/127 |
| 4,429,468 | A | * | 2/1984 | Jimenez et al. | 42/124 |
| 4,707,772 | A | * | 11/1987 | Jimenez et al. | 362/110 |
| 4,959,908 | A | * | 10/1990 | Weyrauch | 42/124 |
| 5,033,219 | A | * | 7/1991 | Johnson et al. | 42/115 |
| 5,086,566 | A | * | 2/1992 | Klumpp | 42/126 |
| 5,201,124 | A | | 4/1993 | Sherman | |
| 5,669,173 | A | * | 9/1997 | Rodney, Jr. | 42/124 |
| 5,787,630 | A | * | 8/1998 | Martel | 42/125 |
| 5,926,964 | A | * | 7/1999 | Korapaty | 42/124 |
| 5,941,006 | A | * | 8/1999 | Horton | 42/124 |
| 6,126,122 | A | * | 10/2000 | Ismert | 248/74.1 |
| 6,425,561 | B2 | | 7/2002 | Wooten et al. | |

OTHER PUBLICATIONS

McMaster–Carr Supply Co. Catalogue (Georgia Catalogue) Vo. 105; p. 2099, "Pipe & Woodworkers' Vises" —See "Bench Yoke Pipe Vises".

McMaster–Carr Supply Co. Catalogue (Georgia Catalogue) vol. 105; p. 2102; "Machinists & Combination Vises" —See "Macarco Heavy Duty Vises".

* cited by examiner

*Primary Examiner*—Leslie A. Braun
*Assistant Examiner*—A. Joseph Wujciak
(74) *Attorney, Agent, or Firm*—Dunlap, Codding & Rogers, P.C.

(57) ABSTRACT

An adjustable weapon auxiliary mount for mounting devices of different diameters, one at a time, to a rail of a weapon. The adjustable weapon auxiliary mount is provided with a base, a device clamp and a rail clamp. The base has a first end, an opposed second end, and a clamping surface formed therebetween. The device clamp is mounted to the base. The device clamp is provided with a clamping member having a clamping surface facing the clamping surface of the base and spatially disposed therefrom so as to define a receiving space for receiving one device and securely gripping the device. The clamping surfaces of the clamping member and the base are configured to securely grip, one at a time, devices having varying diameters within a predetermined range. The device clamp is also provided with a clamping assembly for connecting the clamping member of the device clamp to the base so as to permit adjustment of the receiving space within a predetermined range and thereby permit the devices having varying diameters within the predetermined range to be securely mounted within the receiving space. The rail clamp connects the base to the rail of the weapon.

26 Claims, 2 Drawing Sheets

ADJUSTABLE WEAPON AUXILIARY MOUNT

CROSS-REFERENCE TO RELATED APPLICATIONS

The present patent application is a continuation of U.S. Ser. No. 10/122,273, filed on Apr. 12, 2002; now abandoned, which is a continuation in part of U.S. Ser. No. 09/882,791, filed on Jun. 14, 2001, now U.S. Pat. No. 6,425,561; which is a continuation of Ser. No. 09/434,214, filed on Nov. 4, 1999, now abandoned; which claims priority to the provisional patent application identified by U.S. Ser. No. 60/107,766, which was filed on Nov. 9, 1998. Each of the above-referenced patent applications is incorporated herein by reference for all purposes.

STATEMENT REGARDING FEDERALLY SPONSORED RESEARCH AND DEVELOPMENT

Not Applicable.

BACKGROUND OF THE INVENTION

Devices for mounting sighting equipment, such as scopes or laser sighting equipment are known in the art. These devices are designed to mount a certain configuration and/or size of sighting equipment. For example, prior art devices for mounting scopes having a cylindrically shaped outer peripheral surface are provided with a clamping device having an interior surface which is shaped so as to mate with the cylindrically shaped outer peripheral surface of the scope. This necessitates the prior art device being designed to only securely mount a scope having a predetermined size, such as a one inch diameter. The prior art devices can not securely mount sighting equipment having different sizes, one at a time, onto a weapon.

Weapons having a rail for receiving a scope mount thereon are known in the art. The rail has been provided with a plurality of spaced apart, parallel recesses formed therein so that a recoil pin provided on the scope mount can be disposed in one of the recesses to help prevent movement of the scope mount when the weapon is being fired.

However, to applicants knowledge, an adjustable weapon auxiliary mount which is capable of securely mounting differently sized devices to the weapon, one at a time, is not available. It is to such an improved adjustable weapon auxiliary mount that the present invention is directed.

SUMMARY OF THE INVENTION

The present invention relates to an adjustable weapon auxiliary mount for mounting devices of different diameters, one at a time, to a rail of a weapon. The adjustable weapon auxiliary mount is provided with a base, a device clamp and a rail clamp.

The base has a first end, an opposed second end, and a clamping surface formed therebetween.

The device clamp is mounted to the base. The device clamp is provided with a clamping member having a clamping surface facing the clamping surface of the base and spatially disposed therefrom so as to define a receiving space for receiving one device and securely gripping the device. The clamping surfaces of the clamping member and the base are configured to securely grip, one at a time, devices having varying diameters within a predetermined range. The device clamp is also provided with a clamping assembly for connecting the clamping member of the device clamp to the base so as to permit adjustment of the receiving space within a predetermined range and thereby permit the devices having varying diameters within the predetermined range to be securely mounted within the receiving space.

The rail clamp connects the base to the rail of the weapon.

In one aspect, the present invention relates to an adjustable weapon auxiliary mount that mounts onto the rails of certain military and commercial weapons and into which the user may insert a device, such as a flashlight, for example. The adjustable weapon auxiliary mount is designed so that the beam of the flashlight, for example, will align with the barrel of the weapon so that the user can see where he/she is aiming the weapon. Or, the user may mount a device such as a scope for precise fire at longer ranges, such as a sniper might employ. The adjustable weapon auxiliary mount is designed so that when it is installed it does not interfere with the sighting or operating of the weapon. Nor does it interfere with other attached accessories.

In another aspect, the adjustable weapon auxiliary mount can be attached and removed from the weapon without the need for tools. All parts of the adjustable weapon auxiliary mount are captive on the adjustable weapon auxiliary mount. The adjustable weapon auxiliary mount is made so that it can accept any flashlight with a circular barrel whose diameter is within the range of the specific design.

DETAILED DESCRIPTION OF THE INVENTION

Figure 1:
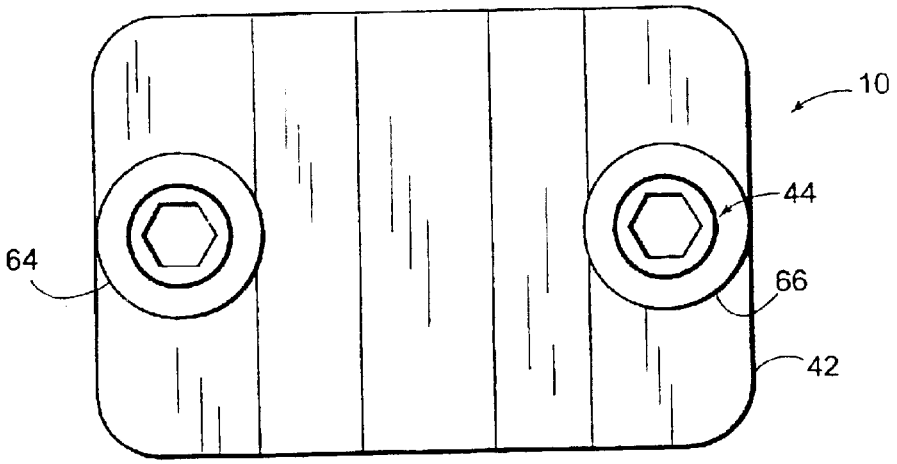
FIG. 1 is a top plan view of a adjustable weapon auxiliary mount constructed in accordance with the present invention.
Figure 2:
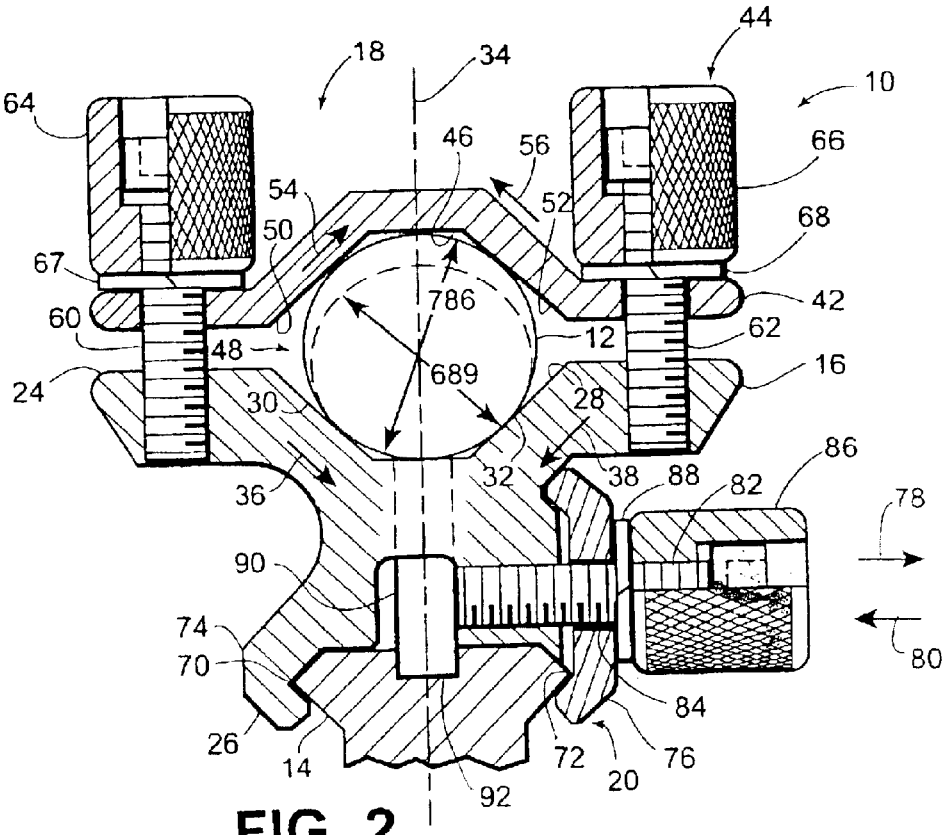
FIG. 2 is a front elevational, partial fragmental view of the adjustable weapon auxiliary mount depicted in FIG. 1 wherein a flashlight is mounted by the adjustable weapon auxiliary mount onto a rail of a weapon and certain parts of the adjustable weapon auxiliary mount are broken away to show three knurled finger nuts.

Referring now to the drawings, and in particular to FIGS. 1 and 2, shown therein and designated by the general reference 10 is an adjustable weapon auxiliary mount for mounting a variety of devices 12 of different diameters, one at a time, to a rail 14 of a weapon (not shown). The device 12 can be a flashlight, laser, scope, or other auxiliary device. In general, the adjustable weapon auxiliary mount 10 includes a base 16, a device clamp 18, and a rail clamp 20.

The base 16 has a first end 24, an opposed second end 26, and a clamping surface 28 formed there between. The clamping surface 28 of the base 16 is engageable with the device 12 and includes a first planar portion 30, and a second planar portion 32 with the first planar portion 30 of the base 16 and the second planar portion 32 of the base 16 are disposed at an angle relative to a clamp axis 34. The first planar portion 30 of the base 16 extends in a direction 36 towards the second planar portion 32 of the base 16. The second planar portion 32 of the base 16 extends in a direction 38 toward the first planar portion 30 of the base 16. The first and second planar portions 30 and 32 are engageable with the device 12.

The device clamp 18 of the adjustable weapon auxiliary mount 10 is mounted to the base 16. The device clamp 18 is provided with a clamping member 42 and a clamping assembly 44. The clamping member 42 has a clamping surface 46 facing the clamping surface 28 of the base 16. The clamping surface 46 of the clamping member 42 is spatially disposed from the clamping surface 28 of the base 16 so as to define a receiving space 48 for receiving the device 12 and securely gripping the device 12. The clamping surfaces 28 and 46 of the base 16 and the clamping member 42 are configured to engage and grip, one at a time, devices 12 having varying diameters within a predetermined range. For example, in one embodiment, the receiving space 48 can accept devices 12, such as flashlights having a circular barrel, with outer diameters from 0.689" to slightly greater than 0.768". The clamping surfaces 28 and 46 can be symmetrically constructed so as to automatically center the device 12 in the receiving space 48. As shown in FIG. 2, the clamping surfaces 28 and 46 can each have a generally trapezoidal shape. In addition, the clamping surfaces 28 and 46 can each have a generally triangular shape.

The clamping surface 46 of the clamping member 42 includes a first planar portion 50, and a second planar portion 52 with the first planar portion 50 of the clamping member 42 and the second planar portion 52 of the clamping member 42 being disposed at an angle relative to the clamp axis 34. The first planar portion 50 of the clamping member 42 extends in a direction 54 toward the second planar portion 52 of the clamping member 42. The second planar portion 52 of the clamping member 42 extends in a direction 56 toward the first planar portion 50 of the clamping member 42. The first planar portion 50 and the second planar portion 52 are engageable with the device 12.

The clamping assembly 44 of the device clamp 18 connects the clamping member 42 of the device clamp 18 to the base 16 so as to permit adjustment of the receiving space 48 within a predetermined range and thereby permit the devices 12 having varying diameters within the predetermined range to be securely mounted within the receiving space 48. The clamping assembly 44 is provided with a first captive screw 60 and a second captive screw 62. The first and second captive screws 60 and 62 are positioned on opposite sides of the receiving space 48. The first and second captive screws 60 and 62 extend through the clamping member 42 and into the base 16 with a portion of the first and second captive screws 60 and 62 extending outwardly from the clamping member 42. The first and second captive screws 60 and 62 can be secured in the base 16 either chemically with a product such as Locktite, or machine threaded so that the first and second captive screws 60 and 62 will be forced into the base 16 and not easily loosened.

The clamping assembly 44 is preferably operated or adjusted without any tools. The clamping assembly 44 is further provided with a first knurled finger nut 64, and a second knurled finger nut 66. The first knurled finger nut 64 is mounted to the portion of the first captive screw 60 extending outwardly from the clamping member 42. The second knurled finger nut 66 is mounted to the portion of the second captive screw 62 extending outwardly from the clamping member 42. The clamping assembly 44 can also be provided with a pair of lock washers 67 and 68 positioned between the first and second knurled finger nuts 64 and 66 and the clamping member 42. The lock washers 67 and 68 can be constructed of a metallic or non-metallic compressible material, such as silicone.

The rail clamp 20 of the adjustable weapon auxiliary mount 10 connects the base 16 to the rail 14 of the weapon. The rail 14 has a first side 70, and a second side 72. The rail clamp 20 includes a fixed clamp arm 74 and a movable clamp arm 76. The fixed clamp arm 74 is engageable with the first side 70 of the rail 14, and the movable clamp arm 76 is engageable with the second side 72 of the rail 14 so as to clamp the rail 14 between the fixed clamp arm 74 and the movable clamp arm 76.

As shown in FIG. 2, the fixed clamp arm 74 can be formed integrally on the second end 26 of the base 16. The movable clamp arm 76 is movable in a first direction 78 generally away from the fixed clamp arm 74, and in a second direction 80 generally toward the fixed clamp arm 74. The rail clamp 20 is also provided with a captive screw 82, which is secured to the base 16, generally near the second end 26 thereof. The captive screw 82 can be secured to the base 16 either chemically with a product such as Locktite, or machine threaded so that the captive screw 82 will be forced into the base 16 and not easily loosened. The captive screw 82 extends through an opening 84 formed through the movable clamp arm 76 such that a portion of the captive screw 82 extends outwardly from the movable clamp arm 76. The rail clamp 20 is further provided with a knurled nut 86 which is disposed on the portion of the captive screw 82 which extends outwardly from the movable clamp arm 76. The knurled nut 86 can be rotated so as to move the movable clamp arm 76 in the first and second directions 78 and 80. A lock washer 88 can be positioned in between the knurled nut 86 and the movable clamp arm 76 so as to prevent inadvertent movement of the knurled nut 86 once the rail clamp 20 is secured on the rail 14. A recoil pin 90 is attached to the base 16 and extends down so that it can engage a recess 92 in the weapon rail. The recoil pin 90 can have a diameter of 3/16". The rail 14 can be a commercially available picketed rail.

The first captive screw 60, the second captive screw 62, the captive screw 82, the first knurled finger nut 64, the second knurled finger nut 66, the knurled nut 86 can be constructed of either aluminum or stainless steel. The lock washer 88 can be constructed of a metallic or a non-metallic compressible material, such as silicone. The base 16, clamping member 42 and the movable clamp arm 76 can be made of metal or plastic. The stability of the adjustable weapon auxiliary mount 10 must be such that it can withstand the forces of the recoil when the weapon is fired and continue to hold the device 12 securely. In military applications, when automatic rifles or machine guns are employed, the adjustable weapon auxiliary mount 10 stability must endure when up to 500–1000 rounds are fired in bursts of up to 20 rounds.

To install the device 12 on the rail 14, the user first loosens the first knurled finger nut 64, the second knurled finger nut 66 and the knurled finger nut 86 by turning them counter clockwise. Then, the user fits the recoil pin 90 into the recess 92 on the rail 14 and tightens knurled finger nut 86. This secures the rail clamp 20 to the rail 14. Next, the user inserts the device 12, such as a flashlight, into the receiving space 48 and secures the device 12 between the clamping member 42 and the base 16 by tightening the first and second knurled finger nuts 64 and 66. Devices 12, such as flashlights, scopes or other devices, can be inserted and removed from the adjustable weapon auxiliary mount 10 without removing the adjustable weapon auxiliary mount 10 from the rail 14 of the weapon and without using any tools.

Figure 3:
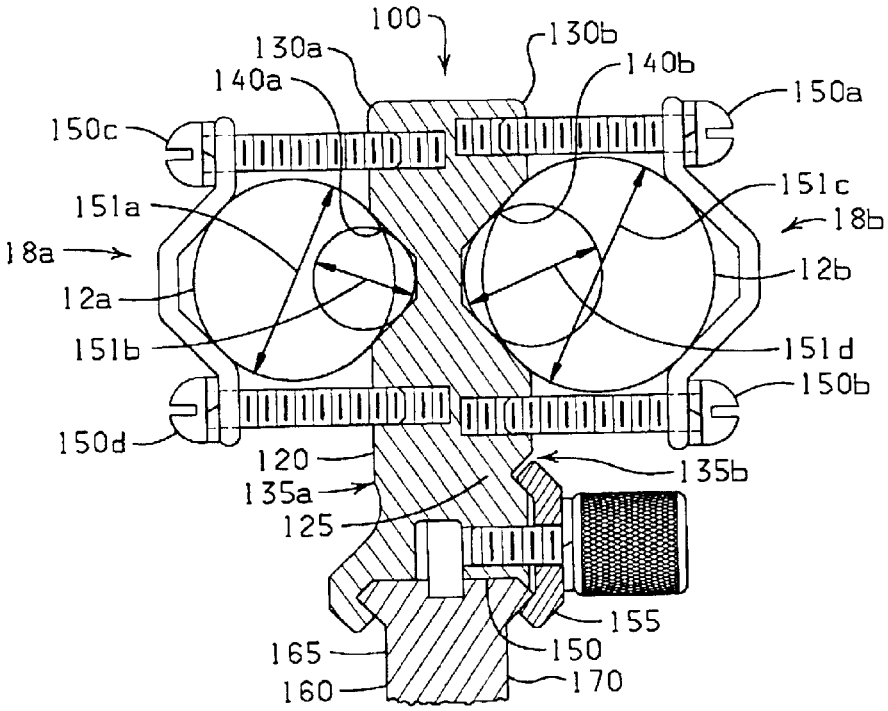
FIG. 3 is a front elevational, partial fragmental view of a second embodiment of an adjustable weapon auxiliary mount.

Referring now to FIG. 3, shown therein and designated by a reference numeral 100, is a second embodiment of an adjustable weapon auxiliary mount, constructed in accordance with the present invention, into which a user may insert one or more devices, such as a flashlight, for example.

The adjustable weapon auxiliary mount is provided with a base 105, a first and second device clamp 18*a* and 18*b*, and a rail clamp 110. The adjustable weapon auxiliary mount 100 is similar in construction and function as the adjustable weapon auxiliary mount 18 hereinbefore described in detail with reference to FIGS. 1 and 2, except as discussed hereinafter.

The base 105 is constructed identically to that of the base 16 of the adjustable weapon auxiliary mount 10 except that the base 105 has a first side 120 and an opposed second side 125. Each side 120 and 125 of the base 105 has a first end 130*a* and 130*b*, an opposed second end 135*a* and 135*b*, and a clamping surface 140*a* and 140*b* formed there between. Each clamping surface 140*a* and 140*b* of the base 105 is constructed identically to that of the clamping surface 28 of the adjustable weapon auxiliary mount 10 as hereinbefore described in detail with reference to FIG. 2. No further description of the clamping surface 140*a* and 140*b* is believed to be necessary to enable one of ordinary skill in the art to construct the clamping surfaces 140*a* and 140*b* of the embodiment of FIG. 3.

The first device clamp 18*a* of the adjustable weapon auxiliary mount 100 is mounted to the first side 120 of the base 105 and the second device clamp 18*b* is mounted to the opposed second side 125 of the base 105. The first device clamp 18*a* and the second device clamp 18*b* are similar in construction and function as the device clamp 18 of the adjustable weapon auxiliary mount 10 hereinbefore described in detail with reference to FIG. 2, except that the clamping assembly 145 of the adjustable weapon auxiliary mount 105 is provided with screws 150*a*, 150*b*, 150*c*, and 150*d* capable of receiving an accessory, such as a screwdriver. Device clamps 18*a* and 18*b* can be sized to receive devices 12*a* and 12*b* having different ranges of diameters. The diameters are designated in FIG. 3 by arrows 151*a*, 151*b*, 151*c*, and 151*d*. No further description is deemed necessary to enable one of ordinary skill in the art to construct the device clamps 18*a* and 18*b*.

The rail clamp 155 of the adjustable weapon auxiliary mount 100 connects the base 105 to the rail 160 of the weapon. The rail 160 has a first side 165 and a second side 170. The rail clamp 155 is similar in construction and function as the rail clamp 20 of the adjustable weapon auxiliary mount 10 hereinbefore described in detail with reference to FIG. 2.

Figure 4:
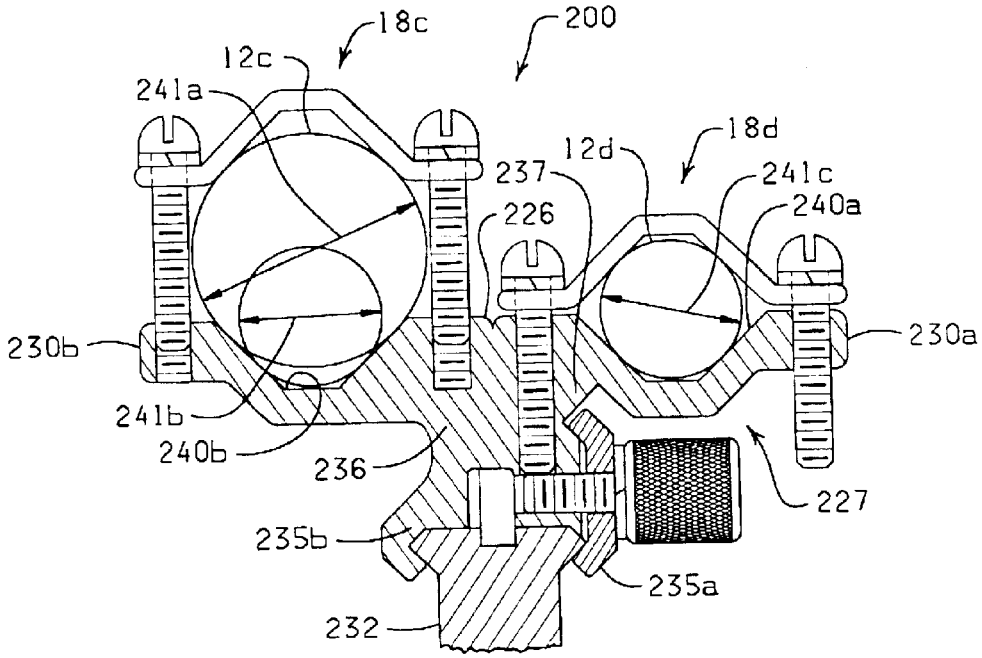
FIG. 4 is a front elevational, partial fragmental view of a third embodiment of an adjustable weapon auxiliary mount constructed in accordance with the presente invention.

Turning now to FIG. 4, shown therein and designated by a reference numeral 200, is a third embodiment of an adjustable weapon auxiliary mount, constructed in accordance with the present invention, for mounting a variety of devices 205 of different diameters, one or more than at a time, to a rail 210 of a weapon (not shown). The adjustable weapon auxiliary mount 200 includes a base 215, a first device clamp 18*c*, a second device clamp 18*d*, and a rail clamp 155. The adjustable weapon auxiliary mount 200 is identical in construction and function to the adjustable weapon auxiliary mount 100 hereinbefore described in detail with reference to FIG. 3, except as discussed hereinafter.

The adjustable weapon auxiliary mount 200 differs only in construction of the base 215 and the location of the first device clamp 18*c* and the second device clamp 18*d*. The base 215 of the adjustable weapon auxiliary mount 200 extends horizontally across and perpendicular to the rail 232 of the weapon rather than vertically as shown in FIG. 3. The base 215 has a first side 226 and an opposed second side 227, a first end 230*a* and 230*b* and an opposed second end 235*a* and 235*b* and a first side 236 and a second side 237. The first end 230*a* and the opposed second end 235*a* have a clamping surface 240*a* formed there between. The first end 230*b* and the opposed second end 235*b* have a clamping service 240*b* formed there between. Each clamping surface 240*a* and 240*b* of the base 215 is constructed identically to that of the clamping surface 28 of the adjustable weapon auxiliary mount 10 as hereinbefore described in detail with reference to FIG. 2.

Each device clamp 18*c* and 18*d* is constructed identically to the device clamps 18*a* and 18*b* of the adjustable weapon auxiliary mount 100 as hereinbefore described in detail with reference to FIG. 3 except that both device clamp 18*c* and device clamp 18*d* are located on the same side 226 of the base 215. Device clamps 18*c* and 18*d* can be sized to receive devices 12*c* and 12*d* having different ranges of diameters. The second device clamp 18*d* can be sized to receive devices 12*d* having outer diameters in a range from about 0.689" to 1.1250". The diameters are designated in FIG. 4 by arrows 241*a*, 241*b*, and 241*c*. Device clamp 18*c* extends out from the first side 236 of the base 215. Device clamp 18*d* extends out from the second side of the base 215. No further description is deemed necessary to enable one of ordinary skill in the art to construct the device clamps 18*a* and 18*b*.

Changes may be made in the combinations, operations, and arrangements of the various parts and elements described herein without departing from the spirit and the scope of the invention as defined in the following claims.

What is claimed is:

1. An adjustable weapon auxiliary mount for mounting, more than one at a time, to a rail of a weapon, the adjustable weapon auxiliary mount comprising:

a base having a first end, an opposed second end, a first clamping surface and a second clamping surface;

a first device clamp mounted to the base, the first device clamp comprising:

a clamping member having a clamping surface facing the first clamping surface of the base and spatially disposed therefrom so as to define a receiving space for receiving one device and securely gripping the device, the clamping surface of the clamping member and the first clamping surface of the base configured to securely grip, one at a time, devices having varying diameters within a predetermined range; and clamping means for connecting the clamping member of the first device clamp to the base so as to permit adjustment of the receiving space within a predetermined range and thereby permit devices having varying diameters within the predetermined range to be securely mounted within the receiving space;

a second device clamp mounted to the base, the second device clamp comprising:

a clamping member having a clamping surface facing the second clamping surface of the base and spatially disposed therefrom so as to define a receiving space for receiving one device and securely gripping the device, the clamping surface of the clamping member of the second device clamp and the second clamping surface of the base configured to securely grip the device; and a clamping means for connecting the clamping member of the second device clamp to the base so as to permit adjustment of the receiving space and thereby permit the device to be securely mounted within the receiving space; and a rail clamp for clamping the base to the rail of the weapon.

2. The adjustable weapon auxiliary mount of claim 1, wherein the clamping means of the first device clamp comprises a first captive screw and a second captive screw with the first and second captive screws being positioned on opposite sides of the receiving space, the first and second captive screws extending through the clamping member of the first device clamp and threadingly engaging the base with a portion of the first and second captive screws extending from the clamping member of the first device clamp, and wherein the clamping means of the first device clamp further comprises a first knurled finger nut and a second knurled finger nut, the first knurled finger nut being mounted to the portion of the first captive screw extending outwardly from the clamping member of the first device clamp, and the second knurled finger nut being mounted to the portion of the second captive screw extending outwardly from the clamping member of the first device clamp.

3. The adjustable weapon auxiliary mount of claim 1 wherein the clamping means of the second device clamp comprises a first captive screw and a second captive screw with the first and second captive screws being positioned on opposite sides of the receiving space, the first and second captive screws extending through the clamping member of the second device clamp and threadingly engaging the base with a portion of the first and second captive screws extending from the clamping member of the second device clamp, and wherein the clamping means of the second device clamp further comprises a first knurled finger nut and a second knurled finger nut, the first knurled finger nut being mounted to the portion of the first captive screw extending outwardly from the clamping member of the second device clamp, and the second knurled finger nut being mounted to the portion of the second captive screw extending outwardly from the clamping member of the second device clamp.

4. The adjustable weapon auxiliary mount of claim 3, wherein the clamping means of the first device clamp comprises a first captive screw and a second captive screw with the first and second captive screws being positioned on opposite sides of the receiving space, the first and second captive screws extending through the clamping member of the first device clamp and threadingly engaging the base with a portion of the first and second captive screws extending from the clamping member of the first device clamp, and wherein the clamping means of the first device clamp further comprises a first knurled finger nut and a second knurled finger nut, the first knurled finger nut being mounted to the portion of the first captive screw extending outwardly from the clamping member of the first device clamp, and the second knurled finger nut being mounted to the portion of the second captive screw extending outwardly from the clamping member of the first device clamp.

5. The adjustable weapon auxiliary mount of claim 1, wherein the clamping surface of the clamping member of the first device clamp includes a first planar portion and a second planar portion with the first planar portion of the clamping member and the second planar portion of the clamping member being disposed at an angle relative to a clamp axis, the first planar portion of the clamping member of the first device clamp extending toward the second planar portion of the clamping member, and the second planar portion of the clamping member of the first device clamp extending toward the first planar portion of the clamping member.

6. The adjustable weapon auxiliary mount of claim 1, wherein the clamping surface of the clamping member of the second device clamp includes a first planar portion and a second planar portion with the first planar portion of the clamping member of the second device clamp, and the second planar portion of the clamping member of the second device clamp being disposed at an angle relative to a clamp axis, the first planar portion of the clamping member of the second device clamp extending toward the second planar portion of the clamping member of the second device clamp, and the second planar portion of the clamping member of the second device clamp extending toward the first planar portion of the clamping member of the second device clamp.

7. The adjustable weapon auxiliary mount of claim 6, wherein the clamping surface of the clamping member of the first device clamp includes a first planar portion and a second planar portion with the first planar portion of the clamping member and the second planar portion of the clamping member being disposed at an angle relative to a clamp axis, the first planar portion of the clamping member of the first device clamp extending toward the second planar portion of the clamping member, and the second planar portion of the clamping member of the first device clamp extending toward the first planar portion of the clamping member.

8. The adjustable weapon auxiliary mount of claim 1, wherein the first clamping surface of the base includes a first planar portion and a second planar portion with the first planar portion of the base and the second planar portion of the base being disposed at an angle relative to a clamp axis, the first planar portion of the base extending toward the second planar portion of the base, and the second planar portion of the base extending toward the first planar portion of the base.

9. The adjustable weapon auxiliary mount of claim 1, wherein the second clamping surface of the base includes a first planar portion and a second planar portion with the first planar portion of the base and the second planar portion of the base being disposed at an angle relative to a clamp axis, the first planar portion of the base extending toward the second planar portion of the base, and the second planar portion of the base extending toward the first planar portion of the base.

10. The adjustable weapon auxiliary mount of claim 9, wherein the first clamping surface of the base includes a first planar portion and a second planar portion with the first planar portion of the base and the second planar portion of the base being disposed at an angle relative to a clamp axis, the first planar portion of the base extending toward the second planar portion of the base, and the second planar portion of the base extending toward the first planar portion of the base.

11. The adjustable weapon auxiliary mount of claim 1, wherein the clamping surface of the clamping member of the first device clamp includes a first planar portion and a second planar portion with the first planar portion of the clamping member and the second planar portion of the clamping member of the first device clamp being disposed at an angle relative to a clamp axis, the first planar portion of the first clamping member of the first device clamp extending toward the second planar portion of the clamping member of the first device clamp, and the second planar portion of the clamping member of the first device clamp extending toward the first planar portion of the clamping member, and wherein the first clamping surface of the base includes a first planar portion and a second planar portion with the first planar portion of the base and the second planar portion of the base being disposed at an angle relative to the clamp axis, the first planar portion of the base extending toward the second planar portion of the base, and the second planar portion of the base extending toward the first planar portion of the base.

12. The adjustable weapon auxiliary mount of claim 1, wherein the clamping surface of the clamping member of the second device clamp includes a first planar portion and a second planar portion with the first planar portion of the clamping member of the second device clamp and the second planar portion of the clamping member of the second device clamp being disposed at an angle relative to a clamp axis, the first planar portion of the clamping member of the second device clamp extending toward the second planar portion of the clamping member, and the second planar portion of the clamping member of the second device clamp extending toward the first planar portion of the clamping member of the second device clamp, and wherein the second clamping surface of the base includes a first planar portion and a second planar portion with the first planar portion of the base and the second planar portion of the base being disposed at an angle relative to a clamp axis, the first planar portion of the base extending toward the second planar portion of the base, and the second planar portion of the base extending toward the first planar portion of the base.

13. The adjustable weapon auxiliary mount of claim 12, wherein the clamping surface of the clamping member of the first device clamp includes a first planar portion and a second planar portion with the first planar portion of the clamping member and the second planar portion of the clamping member of the first device clamp being disposed at an angle relative to a clamp axis, the first planar portion of the first clamping member of the first device clamp extending toward the second planar portion of the clamping member of the first device clamp, and the second planar portion of the clamping member of the first device clamp extending toward the first planar portion of the clamping member, and wherein the first clamping surface of the base includes a first planar portion and a second planar portion with the first planar portion of the base and the second planar portion of the base being disposed at an angle relative to the clamp axis, the first planar portion of the base extending toward the second planar portion of the base, and the second planar portion of the base extending toward the first planar portion of the base.

14. A weapon device mount for mounting flashlights of different sizes, two at a time, to a rail of a weapon, the adjustable weapon auxiliary mount, comprising:

a base having a first end, a second end, and a first clamping surface formed on the first end thereof, and a second clamping surface formed on the second end thereof;

a first device clamp mounted to the base, the first device clamp comprising:

a clamping member having a clamping surface spaced a distance from the clamping surface of the base so as to define a receiving space for receiving one device with the clamping surfaces of the first clamping member and the base being configured to receive and securely grip differently sized devices with each [flashlight] device having an outer diameter within a predetermined range;

a clamping means mounted on the base and the clamping member for moving the clamping member relative to the first clamping surface of the base for clamping the device between the clamping surface of the clamping member and the first clamping surface of the base;

a second device clamp mounted to the base, the second device clamp comprising:

a clamping member having a clamping surface spaced a distance from the second clamping surface of the base so as to define a receiving space for receiving one device with the clamping surface of the second clamping member and the second clamping surface of the base being configured to receive and securely grip differently sized devices with each device having an outer diameter within a predetermined range; and a clamping means mounted on the base and the clamping member for moving the clamping member relative to the second clamping surface of the base for clamping the device between the clamping surface of the clamping member and the second clamping surface of the base; and a rail clamp for connecting the base to the rail of the weapon.

15. The weapon device mount of claim 14, wherein the clamping means of the first device clamp comprises a first captive screw and a second captive screw with the first and second captive screws being positioned on opposite sides of the receiving space, the first and second captive screws extending through the clamping member of the first device clamp and engaging the base with a portion of the first and second captive screws extending from the clamping member of the first device clamp, and wherein the clamping means of the first device clamp further comprises a first knurled finger nut and a second knurled finger nut, the first knurled finger nut being mounted to the portion of the first captive screw extending outwardly from the clamping member of the first device clamp, and the second knurled finger nut being mounted to the portion of the second captive screw extending outwardly from the clamping member of the first device clamp.

16. The adjustable weapon auxiliary mount of claim 14, wherein the clamping means of the second device clamp comprises a first captive screw and a second captive screw with the first and second captive screws being positioned on opposite sides of the receiving space, the first and second captive screws extending through the clamping member of the second device clamp and engaging the base with a portion of the first and second captive screws extending from the clamping member of the second device clamp, and wherein the clamping means of the second device clamp further comprises a first knurled finger nut and a second knurled finger nut, the first knurled finger nut being mounted to the portion of the first captive screw extending outwardly from the clamping member of the second device clamp, and the second knurled finger nut being mounted to the portion of the second captive screw extending outwardly from the clamping member of the second device clamp.

17. The weapon device mount of claim 16, wherein the clamping means of the first device clamp comprises a first captive screw and a second captive screw with the first and second captive screws being positioned on opposite sides of the receiving space, the first and second captive screws extending through the clamping member of the first device clamp and engaging the base with a portion of the first and second captive screws extending from the clamping member of the first device clamp, and wherein the clamping means of the first device clamp further comprises a first knurled finger nut and a second knurled finger nut, the first knurled finger nut being mounted to the portion of the first captive screw extending outwardly from the clamping member of the first device clamp, and the second knurled finger nut being mounted to the portion of the second captive screw extending outwardly from the clamping member of the first device clamp.

18. The weapon device mount of claim 17, wherein the clamping means of the first and second device clamps further comprises a first washer and a second washer, the first washer positioned between the first knurled nut and the clamping member, and the second washer positioned between the second knurled nut and the clamping member.

19. The adjustable weapon auxiliary mount of claim 14, wherein the clamping surface of the clamping member of the first device clamp includes a first planar portion and a second planar portion with the first planar portion of the clamping member of the first device clamp and the second planar portion of the clamping member of the first device clamp being disposed at an angle relative to a clamp axis, the first planar portion of the clamping member of the first device clamp extending toward the second planar portion of the clamping member first device clamp, and the second planar portion of the clamping member of the first device clamp extending toward the first planar portion of the clamping member of the first device clamp.

20. The adjustable weapon auxiliary mount of claim 14, wherein the clamping surface of the clamping member of the second device clamp includes a first planar portion and a second planar portion with the first planar portion of the clamping member of the second device clamp and the second planar portion of the clamping member of the second device clamp being disposed at an angle relative to a clamp axis, the first planar portion of the clamping member of the second device clamp extending toward the second planar portion of the clamping member of the second device clamp, and the second planar portion of the clamping member of the second device clamp extending toward the first planar portion of the clamping member of the second device clamp.

21. The adjustable weapon auxiliary mount of claim 20, wherein the clamping surface of the clamping member of the first device clamp includes a first planar portion and a second planar portion with the first planar portion of the clamping member of the first device clamp and the second planar portion of the clamping member of the first device clamp being disposed at an angle relative to a clamp axis, the first planar portion of the clamping member of the first device clamp extending toward the second planar portion of the clamping member first device clamp, and the second planar portion of the clamping member of the first device clamp extending toward the first planar portion of the clamping member of the first device clamp.

22. The adjustable weapon auxiliary mount of claim 14, wherein the first clamping surface of the base and the second clamping surface of the base includes a first planar portion and a second planar portion with the first planar portion of the base and the second planar portion of the base being disposed at an angle relative to a clamp axis, the first planar portion of the base extending toward the second planar portion of the base, and the second planar portion of the base extending toward the first planar portion of the base.

23. The adjustable weapon auxiliary mount of claim 14, wherein the clamping surface of the clamping member of the first device clamp includes a first planar portion and a second planar portion with the first planar portion of the clamping member of the first device clamp and the second planar portion of the clamping member of the first device clamp being disposed at an angle relative to a clamp axis, the first planar portion of the clamping member extending toward the second planar portion of the clamping member, and the second planar portion of the clamping member extending toward the first planar portion of the clamping member, and wherein the first clamping surface of the base includes a first planar portion and a second planar portion with the first planar portion of the base and the second planar portion of the base being disposed at an angle relative to the clamp axis, the first planar portion of the base extending toward the second planar portion of the base, and the second planar portion of the base extending toward the first planar portion of the base.

24. The adjustable weapon auxiliary mount of claim 14, wherein the clamping surface of the clamping member of the second device clamp includes a first planar portion and a second planar portion with the first planar portion of the clamping member of the second device clamp and the second planar portion of the clamping member of the second device clamp being disposed at an angle relative to a clamp axis, the first planar portion of the clamping member extending toward the second planar portion of the clamping member, and the second planar portion of the clamping member extending toward the first planar portion of the clamping member, and wherein the second clamping surface of the base includes a first planar portion and a second planar portion with the first planar portion of the base and the second planar portion of the base being disposed at an angle relative to the clamp axis, the first planar portion of the base extending toward the second planar portion of the base, and the second planar portion of the base extending toward the first planar portion of the base.

25. The adjustable weapon auxiliary mount of claim 24, wherein the clamping surface of the clamping member of the first device clamp includes a first planar portion and a second planar portion with the first planar portion of the clamping member of the first device clamp and the second planar portion of the clamping member of the first device clamp being disposed at an angle relative to a clamp axis, the first planar portion of the clamping member extending toward the second planar portion of the clamping member, and the second planar portion of the clamping member extending toward the first planar portion of the clamping member, and wherein the first clamping surface of the base includes a first planar portion and a second planar portion with the first planar portion of the base and the second planar portion of the base being disposed at an angle relative to the clamp axis, the first planar portion of the base extending toward the second planar portion of the base, and the second planar portion of the base extending toward the first planar portion of the base.

26. An adjustable weapon auxiliary mount for mounting devices of different diameters, more than one at a time, to a rail of a weapon, the adjustable weapon auxiliary mount comprising:

a base having a first end, an opposed second end, and a first clamping surface and a second clamping surface formed therebetween;

a first device clamp mounted to the base, the device clamp comprising:

a clamping member having a clamping surface facing the clamping surface of the base and spatially disposed therefrom so as to define a receiving space for receiving one device and securely gripping the device; and a clamping means for connecting the clamping member of the device clamp to the base so as to permit adjustment of the receiving space within a predetermined range and thereby permit the devices having varying diameters within the predetermined range to be securely mounted within the receiving space;

a second device clamp mounted to the base, the device clamp comprising:

a clamping member having a clamping surface facing the second clamping surface of the base and spatially disposed therefrom so as to define a receiving space for receiving one device and securely gripping the device; and a clamping means for connecting the clamping member of the second device clamp to the base so as to permit adjustment of the receiving space within a predetermined range and thereby permit the devices having varying diameters within the predetermined range to be securely mounted within the receiving space; and a rail clamp for clamping the base to the rail of the weapon, wherein the base, the clamping members of the first and second device clamps and clamping means are all captive.

* * * * *